United States Patent [19]

Randall

[11] Patent Number: 4,487,096

[45] Date of Patent: Dec. 11, 1984

[54] SCREW TYPE BLIND RIVET DRIVER ADAPTER

[76] Inventor: Thomas B. Randall, 2628 N. 1375 W., Clinton, Utah 84015

[21] Appl. No.: 469,177

[22] Filed: Feb. 23, 1983

[51] Int. Cl.[3] ..... B25B 13/06

[52] U.S. Cl. ..... 81/121 A; 81/445; 81/459; 81/57.14; 72/114

[58] Field of Search ..... 72/391, 114; 81/57.29, 81/57.3, 57.14, 57.13, 121 R, 121 A, 445, 459; 29/243.53

[56] References Cited

U.S. PATENT DOCUMENTS

| | | | |
|---|---|---|---|
| 793,503 | 6/1905 | Bousser | 81/121 R |
| 1,398,889 | 11/1921 | Clark | 81/121 R |
| 1,573,464 | 2/1926 | Topping . | |
| 1,854,116 | 4/1932 | Schebeko . | |
| 2,566,183 | 8/1951 | Forss | 81/57.14 |
| 2,703,030 | 3/1955 | Marvin | 81/57.29 |
| 2,900,856 | 8/1959 | Maier | 81/57.13 |
| 3,602,071 | 8/1971 | Juhasz | 81/57.14 |
| 4,242,932 | 1/1981 | Barmore | 81/437 |

*Primary Examiner*—Daniel C. Crane
*Assistant Examiner*—David B. Jones
*Attorney, Agent, or Firm*—Donald J. Singer; Charles E. Bricker

[57] ABSTRACT

An apparatus for setting screw type blind rivets including a power drill having a laterally offset drilling head, and an adapter therefor interchangeable with the normal drill bit, which adapter has a laterally elongated slot adapted for receiving the flatted mandrel of the rivet while setting the rivet.

3 Claims, 8 Drawing Figures

SCREW TYPE BLIND RIVET DRIVER ADAPTER

RIGHTS OF THE GOVERNMENT

There is reserved to the Government of the United States a nonexclusive, irrevocable, royalty-free license in the invention described herein with power to grant licenses for all governmental purposes.

BACKGROUND OF THE INVENTION

Mechanical joints can be fabricated in a number of ways, all of which can be classified as either temporary or permanent. Temporary joints include, for example, screw threads, clamps, and the like, and permanent joints include, for example, brazed, welded, adhesively bonded, riveted, and the like.

It often happens that two or more structural members must be joined together, or an accessory, such as a cable strap, must be joined to a structural member but the joining point is relatively inaccessible. For example, in an aircraft structure, two or more members must often be joined together at a point that is completely inaccessible from one side and only inconveniently accessible from the other side, as for example, near an access port in a bulkhead which is positioned a short distance away from the members to be joined.

If the joining point lies directly in front of an access port, it is a simple matter to drill through the members to be joined, then join them together using, for example, a self-tapping screw or a blind rivet. If, however, the joining point is not directly accessible, use of a self-tapping screw is well nigh impossible, while use of blind rivets may be precluded due to the size of the rivet tool.

Blind rivets are available in three general types: screw, mandrel and explosive. In the explosive type an explosive charge in the point is set off by a special hot iron: the explosion expands the point and sets the rivet. In the mandrel type, the rivet is set as the mandrel is pulled through. The explosive and the mandrel types of blind rivets have certain drawbacks which limit their usefulness in fabrication or repair of an aircraft structure. For example, the explosive type cannot be used in or near a potentially explosive or inflammable environment, while the mandrel type cannot be used where a structure must be sealed, inasmuch as the set rivet is hollow. Accordingly, for many aircraft applications, screw type rivets are used. This type of rivet, illustrated hereinafter, comprises a threaded mandrel, a bushing having an integral rivet head and a threaded bore, and an expansible sleeve. In use the threaded rivet is inserted into a drilled hole in a member so that the head is butted against the front side of the member, a special driving tool is positioned over the rivet head, the mandrel is screwed through the bushing and, when the rivet is set, the mandrel is broken off flush with the top of the rivet head. The bushing is longer than the total thickness of the members to be joined together and is tapered at its outer end. As the mandrel is screwed through the bushing, it urges the sleeve onto the tapered portion of the bushing and over the outside surface of the bushing. The sleeve becomes compressed between the head of the threaded mandrel and the backside of the members being joined, thus "setting" the rivet. The resulting rivet is solid and strong.

The holes for the screw type blind rivets may be drilled in relatively inaccessible areas using a specialty drill, known in the trade as a "foot" drill. This drill has a lateral extension for holding the drill bit at some distance away from the motor housing.

In practice, once a hole is drilled in a relatively inaccessible place and a screw type rivet is inserted into the hole, it frequently happens that the special driving tool cannot be positioned so that it holds the rivet perpendicular, or nearly so, to the members being joined together. If the special driving tool holds, drives and sets the screw type rivet at an angle, it elongates and distorts the rivet hole. These rivets, driven and set at an angle away from the perpendicular will often work loose.

Accordingly, it is an object of the present invention to provide means for driving and setting a screw type rivet in a relatively inaccessible place.

Other objects and advantages of the present invention will be apparent to those skilled in the art from the following description of the invention.

DESCRIPTION OF THE PREFERRED EMBODIMENTS

Figure 1:
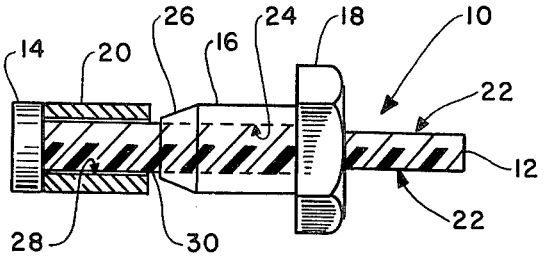
FIG. 1 is a plan view, partly in section, of a screw type blind rivet.
Figure 3:
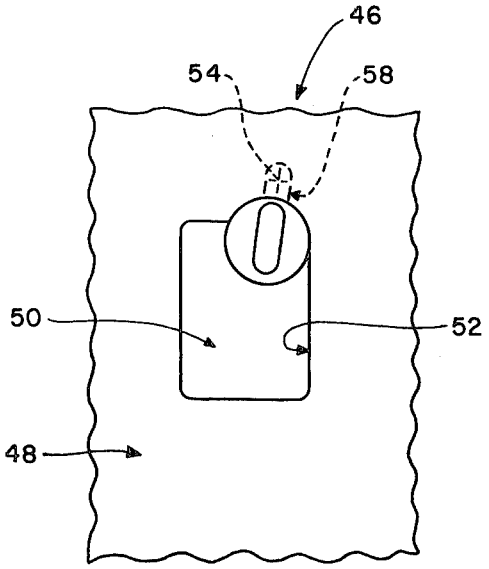
FIG. 3 is a front elevation of an aircraft structure showing "foot" drill drilling a hole for a blind rivet.

FIG. 1 illustrates a screw type blind rivet, partly in cross section, prior to installation. The rivet, designated generally by the reference numeral 10, comprises a threaded bolt or mandrel 12 having an integral head 14, a bushing 16 having an integral hexagonal head 18, and an expansible sleeve 20. The end portion of the bolt 12 has parallel flats 22 machined down to at least the minor diameter of the threads or slightly below. The bushing 16 has integral threads through its central bore 24 which threads are complementary to the threads on the bolt 12. The end of the bushing 16 opposite the head 18 is tapered, as at 26. The sleeve 20 has a longitudinal bore 28 which is slightly greater than the major diameter 30 of the bolt 12. The outside diameters of each of the bolt head 14, the sleeve 20 and the majority of the bushing 16 are substantially equal.

Figure 2:
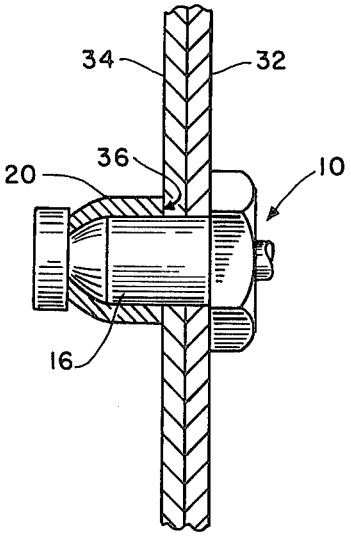
FIG. 2 is a sectional view showing two metal panels joined together by a screw type blind rivet.

Referring now to FIG. 2, wherein like numerals are defined as above, two panels 32 and 34 are shown joined together by a rivet 10. In practice the panels are prepared for joining by first drilling an appropriately sized hole through both, then inserting a rivet 10 into the hole. The rivet 10 is "set" in the hole by turning the bolt 12 out of the bushing 16 while simultaneously holding the head 18 of bushing 16 stationary. As the bolt 12 turns, or is screwed out of bushing 16, the head 14 is drawn toward bushing 16. The advancing head 14 pushes the sleeve 20 onto the tapered portion 26 thence onto the nontapered portion of bushing 16 until the advancing edge 36 of the sleeve 20 contacts the reverse side of panel 34. When the bolt head 14 is fully drawn up to the bushing 16, the excess bolt projecting out the front side of bushing head 18 is shorn off.

In the rivet 10 the sleeve 20 is fabricated from a relatively softer metal or alloy than the other parts, so that the sleeve 20 can be deformed as explained above.

Figure 5:
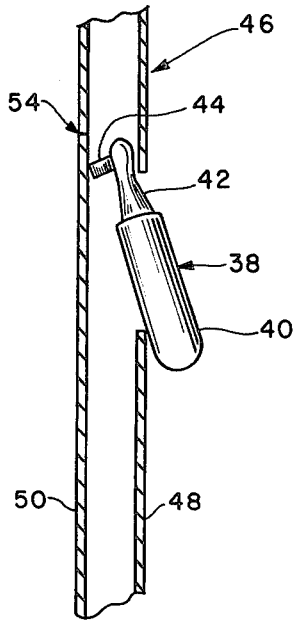
FIG. 5 is a side elevation illustrating the problem of using a commercial screw type blind rivet driver in a restricted space.

Referring briefly to FIG. 5, there is illustrated a power tool 38 which may be used to drive or "set" screw type blind rivets in accessible areas. The driven tool 38 has an electric or pneumatic rotary motor 40, a right angle power transmission head 42, a fixed socket 44 for holding the bushing head 18 of a screw type blind rivet, and a rotatable member, not illustrated, positioned within the socket 44 for gripping and turning the parallel flatted end of bolt 12 or rivet 10. Such a right-angle driving tool is available from the Aro Corporation, Bryan, N.Y. A straight configured rivet drive tool is available from the Chicago Corporation, Utica, N.Y. The screw type blind rivets are also available from these sources.

FIGS. 3–5 and 8 illustrate the installation and problems of installation of a screw type blind rivet 10 in a place having restricted access. Shown in these figures is a structure 46 having a front panel 48 and a rear panel 50, each of which has a front sid and a backside. The front side of each of the panels 48 and 50 is the side from which access is afforded, and the backside is the reverse, the inaccessible side. The panel 48 has a cutout access port 52.

Figure 4:
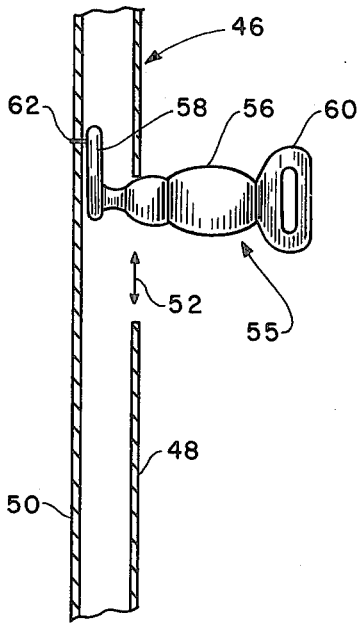
FIG. 4 is a side elevation showing a "foot" drill drilling a hole for a blind rivet.

For the purpose of illustration, it is desired to insert a blind rivet into the rear panel 50 at a point 54 which is not directly in the line of sight of the cutout port 52. For this purpose a power drill 55, known in the art as a "foot" drill, is employed. Referring specifically to FIG. 4, the "foot" drill comprises an electric or pneumatic rotary motor 56, an offset power transmission housing or "foot" 58, a handle 60 and a drill bit 62. The drill bit 62 has a machine screw threaded shank, not shown, instead of the more common smooth straight or tapered shank. The foot 58 of drill 55 has means having complementary threads for receiving the bit 62. The foot 58 holds the drill bit 62 parallel to the axis of rotation of the motor 56. In operation, the drill 55 is positioned so that the foot 58 having the bit 62 positioned therein can be passed into the port 52. The drill 55 is then positioned so that the point of drill bit 62 is located where it is desired to drill the hole 54. The hole 54 is thereafter drilled in normal fashion.

Referring now to FIG. 5, it often happens that an access port is too small to allow passage of the driving tool 38 into the space between the front panel 48 and the rear panel 50. Or, it may be that the combined length of the socket 44 and the depth of the head 42 is greater than the interpanel space 48–50.

Figure 6:
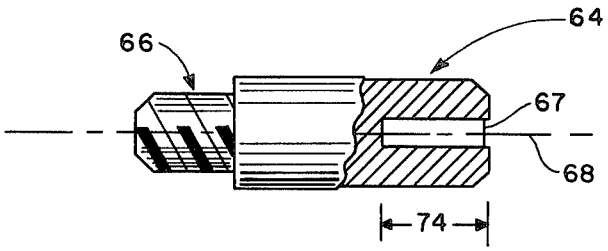
FIG. 6 is a side view of the adapter of this invention.
Figure 7:
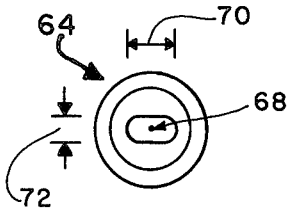
FIG. 7 is a front view of the adapter of this invention.

To alleviate these problems, I have invented an adapter 64, as shown in FIGS. 6 and 7, which converts the "foot" drill into a screw type blind rivet driving tool. The adapter 64 is a cylindrical body having machine screw threads 66 at one end thereof which are the same as the threads on the drill bit 62. The other end of the adapter 64 has a laterally elongated slot 67 positioned symmetrically about the rotational axis 68 of adapter 64, having a width 70 slightly greater than the major diameter 30 of bolt 12 (FIG. 1), a height 72 slightly greater than the flats 22 of bolt 12 (FIG. 1), which are substantially equal to or slightly less than the minor diameter of the threaded bolt 12 (FIG. 1), and a depth 74 at least equal to the length of bolt 12 which is shorn off after setting the rivet.

The dimensions of width 70 and height 72 must be such that the slot 67 can be positioned over a bolt 12 without binding, but not so large that the bolt 12 would slop around while the adapter 64 is being rotated by the "foot" drill. In general, these requirements are satisfied when the dimensions 70 and 72 are about 0.005 to 0.015-inch greater than the specified dimensions of commercially available screw type blind rivets 10.

Figure 8:
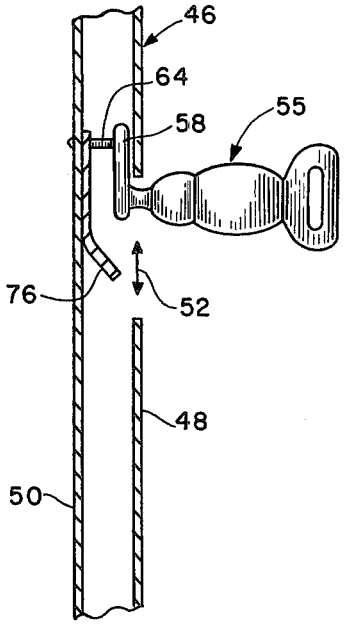
FIG. 8 is a side elevation of the adapter of this invention mounted on a "foot" drill and setting a screw type blind rivet.

FIG. 8 illustrates the use of the adapter of this invention. After the hole 54 is drilled, as shown in FIG. 4, the drill bit 62 is backed out of the hole and the drilling apparatus 55 is removed from the access port 52. The drill bit 62 is unscrewed and removed from the "foot" 58 of drill 55, and replaced with the adapter 64. The exposed portion of bolt 12 of a screw type blind rivet 10 is inserted into the slot 67, then the foot 58 is passed into the access port 52 and the rivet 10 inserted into hole 54. A wrench 76 is positioned to prevent the head 18 of rivet 10 from turning. The drill 55 is started and the rivet is set. The exposed portion of the bolt 12 is then broken off.

Reasonable variations may be made, all within the spirit of the invention and the scope of the appended claims.

I claim:

1. An adapter for a power drill for setting screw type blind rivets, said rivets comprising a threaded mandrel having a driving end portion with parallel driving flats machined down to at least the minor diameter of the threads of said mandrel, which adapter consists essentially of a cylindrical body having an axis, said body further having a threaded end portion and an opposite end having a laterally elongated slot therein, said slot having a major and minor diameter with the major diameter of the slot extending transverse to said cylindrical body axis, and forming a shape complementary to said driving end portion of said rivet mandrel, said slot having positioned symmetrically about the rotational axis of said adapter, said slot being adapted to receive the said flatted mandrel of said rivet therein.

2. An apparatus for setting screw type blind rivets, said rivets comprising a threaded mandrel having a driving end portion with parallel driving flats machined down to at least the minor diameter of the threads of said mandrel, which apparatus comprises, in combination: a motor means; a setting adapter consisting essentially of a cylindrical body having an axis, said body further having a threaded end portion and an opposite end having a laterally elongated slot therein, said slot having a major and minor diameter with the major diameter of the slot extending transverse to said cylindrical body axis, and forming a shape complementary to said driving end portion of said rivet mandrel, said slot being positioned symmetrically about the rotational axis of said adapter, said slot being adapted to slidably receive the said flatted mandrel of said rivets therein; and a power transmission means operably connected to said motor means and having a threaded socket for receiving the threaded end portion of said setting adapter, for transmitting rotation from said motor means to said setting adapter.

3. The apparatus of claim 2 wherein said power transmission means has said socket laterally offset from said motor.

* * * * *

UNITED STATES PATENT AND TRADEMARK OFFICE

CERTIFICATE OF CORRECTION

PATENT NO. : 4,487,096

DATED : December 11, 1984

INVENTOR(S) : Randall, Thomas B.

It is certified that error appears in the above—identified patent and that said Letters Patent is hereby corrected as shown below:

Claim 1, line 13, the phrase "having positioned symmetrically" should read "being positioned symmetrically".

Column 3, line 26, after "front", "sid" should read "side".

Signed and Sealed this

*Twenty-first* Day of *May 1985*

[SEAL]

*Attest:*

DONALD J. QUIGG

*Attesting Officer*

*Acting Commissioner of Patents and Trademarks*